US005613011A

United States Patent [19]

Chase et al.

[11] Patent Number: 5,613,011

[45] Date of Patent: Mar. 18, 1997

[54] MICROPHONE ASSEMBLY MOUNTED TO A BEZEL WHICH FRAMES A MONITOR SCREEN OF A COMPUTER

[75] Inventors: Steven B. Chase, Cupertino; James K. Levins, Santa Clara, both of Calif.

[73] Assignee: Apple Computer, Inc., Cupertino, Calif.

[21] Appl. No.: 415,464

[22] Filed: Apr. 3, 1995

[51] Int. Cl.[6] ..... H04R 25/00

[52] U.S. Cl. ..... 381/169; 381/168

[58] Field of Search ..... 381/90, 188, 205, 381/168, 169, 91, 112, 113, 114, 115, 152, 170, 171, 173, 174, 176, 177, 180; 181/158

[56] References Cited

U.S. PATENT DOCUMENTS 4,550,429 10/1985 Burbank et al. ..... 381/90

5,201,069 4/1993 Barabolak ..... 381/205

5,481,618 1/1996 Ross et al. ..... 381/205

*Primary Examiner*—Sinh Tran

*Attorney, Agent, or Firm*—Burns, Doane, Swecker & Mathis, L.L.P.

[57] ABSTRACT

A personal computer includes an outer housing which includes a front bezel that frames a monitor screen. A microphone assembly is attached to the bezel by a friction-fit. The bezel includes a cylindrical projection forming a socket. The microphone assembly includes a circuit board to which is mounted a microphone-carrying resilient body. The body is attached to the circuit board by spring fingers and includes a groove for receiving the cylindrical projection of the bezel.

9 Claims, 3 Drawing Sheets

MICROPHONE ASSEMBLY MOUNTED TO A BEZEL WHICH FRAMES A MONITOR SCREEN OF A COMPUTER

BACKGROUND OF THE INVENTION

The present invention relates to a microphone assembly and the mounting of such an assembly to an appliance such as a personal computer.

A personal computer typically comprises a metal chassis to which the main operational components are mounted, and an outer housing which encompasses the chassis. The computer can include a microphone assembly for capturing external sound into the computer, e.g., for providing sound effects that can be played back at certain times, or to enable a user to utilize a speaker telephone connected to the computer, etc.

It is conventional to mount the microphone assembly to the inside surface of one of the housing panels, such as a front bezel which frames a monitor screen of the computer. For example, as shown in FIG. 11, the inside surface of a bezel 1 can be provided with a cylindrical socket 2 that communicates with a sound-admitting through-hole 3 in the bezel. A microphone element 4 is mounted within a cylindrical rubber plug 5, the plug being secured to a circuit board 6 by adhesive. The microphone element 5 is electrically connected to the circuit board, whereby the plug, microphone element, and circuit board form a unitary microphone assembly. That assembly is mounted to the bezel by pushing the plug into the socket, and by attaching additional snap members (not shown) between the circuit board and the bezel.

The overall cost of manufacturing such a microphone assembly is increased by the need to provide a snap structure to augment the frictional securement of the plug within the socket, and the necessity of applying an adhesive for securing the plug to the circuit board. It would be desirable, therefore, to simplify the manufacture and installation of such a microphone assembly.

SUMMARY OF THE INVENTION

The present invention relates to a microphone assembly for connection to a housing. The microphone assembly comprises a circuit board, a body mounted to the circuit board, and a microphone element mounted in the body. The circuit board has an aperture extending therethrough, and the body includes a rearwardly projecting spring finger received in the aperture and forming an interference fit therewith for mounting the body to the circuit board. The body also includes an interior chamber, and a through-hole extending forwardly from the chamber and through the body. A forwardly open groove encompass the chamber and is adapted to receive a wall of a socket to which the microphone assembly is to be mounted. The microphone element is mounted in the chamber and is electrically connected to the circuit board.

The groove is preferably of annular configuration to receive a correspondingly shaped annular wall of the socket.

The circuit board preferably includes through-holes for receiving mounting posts that are formed on the structure to which the microphone is to be connected.

The invention also relates to the combination of an appliance and a microphone assembly. The appliance has a housing which includes a wall in which a sound-admitting through-hole is formed. A cylindrical projection extends from a surface of the wall to form a socket communicating with the through-hole. The microphone assembly comprises a circuit board, a body mounted to the circuit board, and a microphone element mounted in the body. The circuit board has an aperture formed therethrough, and the body includes a rearwardly extending spring finger extending through the aperture to form an interference fit with the circuit board. The body includes an interior chamber and a forwardly open groove encompassing the chamber and receiving the projection with a friction-fit. The body further includes a hole communicating the chamber with the through-hole in the wall. The microphone element is mounted in the interior chamber and is electrically connected to the circuit board.

The appliance is preferably a personal computer, and the housing wall is defined by a front bezel on which the projection is formed.

BRIEF DESCRIPTION OF THE DRAWINGS

The objects and advantages of the invention will become apparent from the following detailed description of a preferred embodiment thereof in connection with the accompanying drawings in which like numerals designate like elements and in which.

DETAILED DESCRIPTION OF A PREFERRED EMBODIMENT OF THE INVENTION

Figure 1:
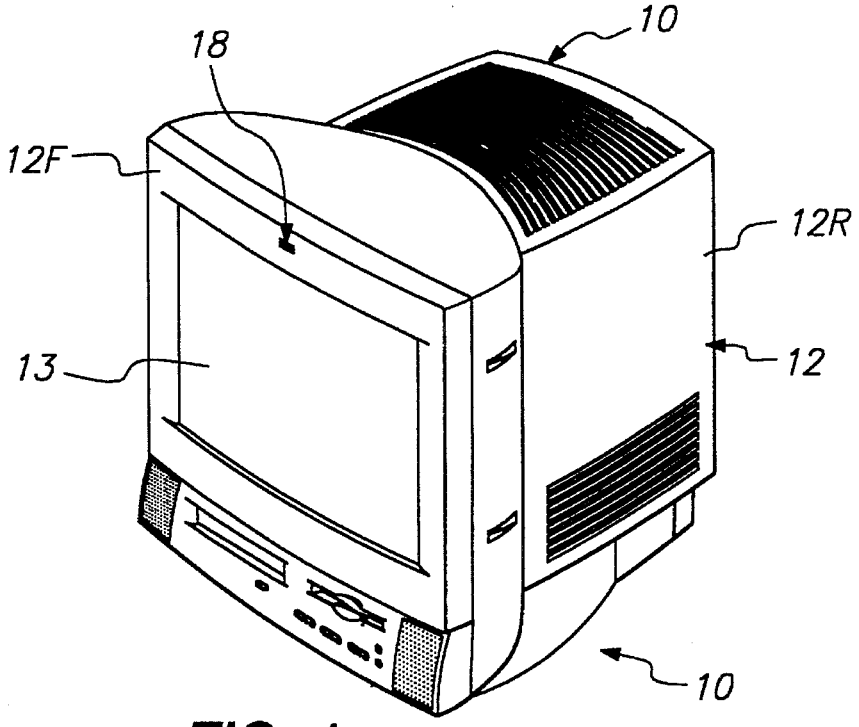
FIG. 1 is a front perspective view of a personal computer in which a microphone assembly according to the present invention is mounted.
Figure 2:
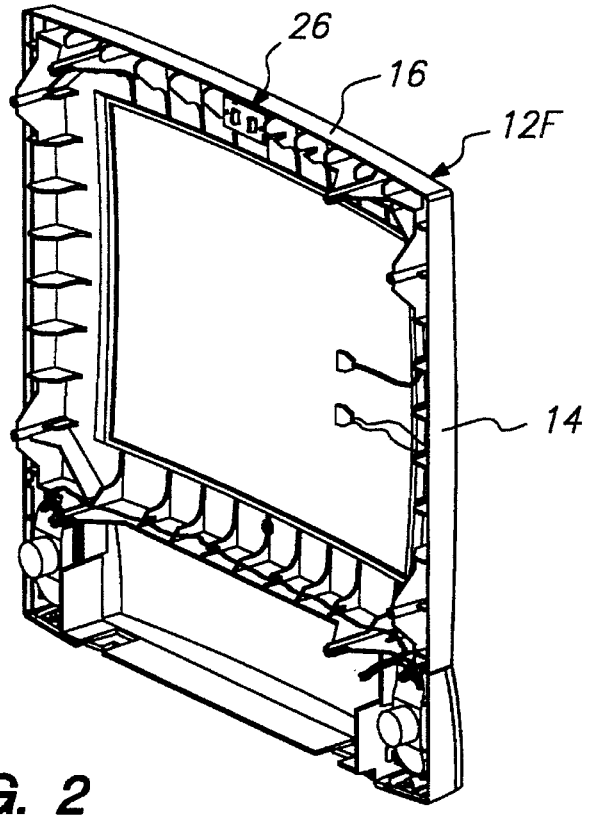
FIG. 2 is a rear perspective view of a bezel portion of a housing of the computer and a microphone assembly according to the present invention mounted to the bezel.
Figure 3:
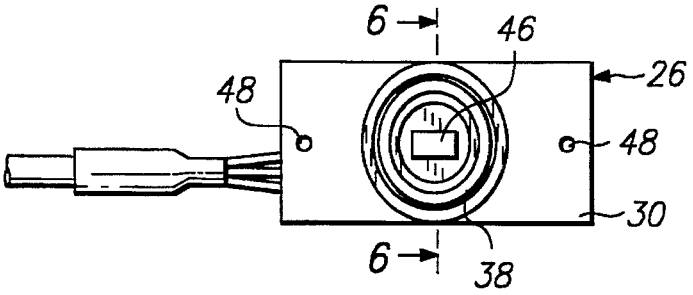
FIG. 3 is a front elevational view of the microphone assembly according to the present invention.

A personal computer 10 depicted in FIG. 1 comprises an outer housing 12 encompassing an internal chassis (not shown). The housing includes a front housing section 12F in the form of a bezel which is connected to a rear housing section 12R, and arranged to frame a monitor screen 13. The bezel 12F includes a pair of vertical side portions 14 and a horizontal upper portion 16.

Figure 4:
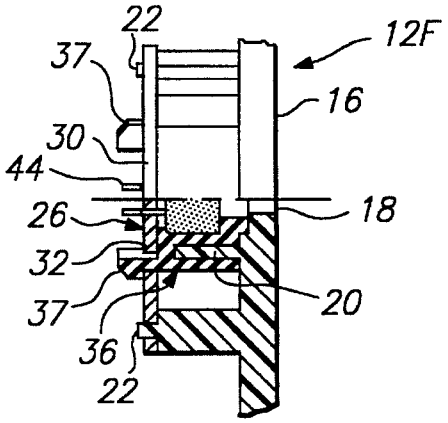
FIG. 4 is a partial sectional view taken along line 4—4 in FIG. 8, with the microphone assembly mounted to the bezel.
Figure 5:
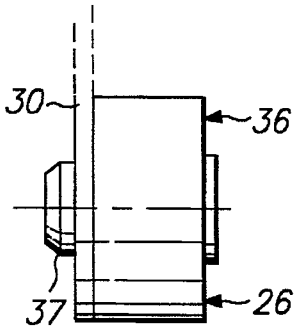
FIG. 5 is a side elevational view of the microphone assembly.
Figure 6:
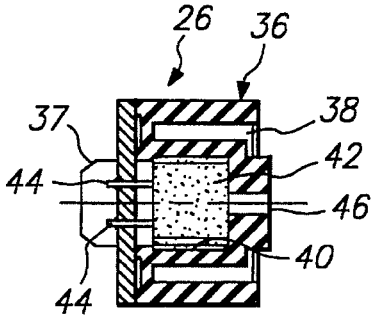
FIG. 6 is a sectional view taken along line 6—6 in FIG. 3.
Figure 7:
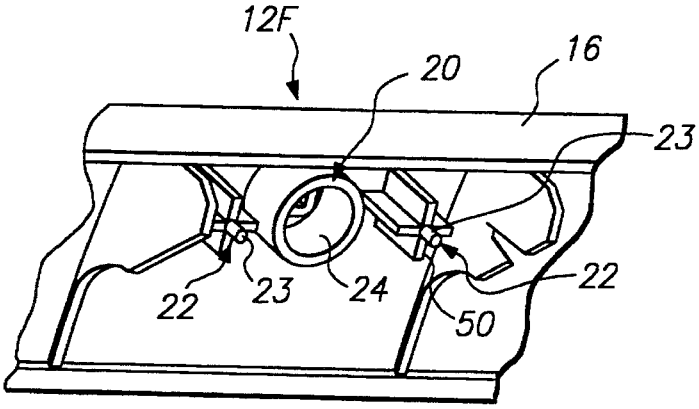
FIG. 7 is a fragmentary perspective view of a rear portion of the bezel, depicting a socket to which the microphone assembly is to be mounted.
Figure 11:
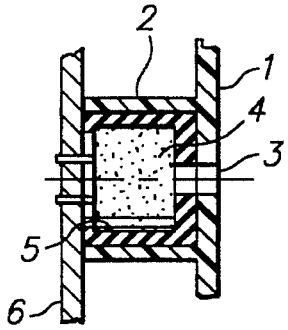
FIG. 11 (PRIOR ART)
FIG. 11 is a longitudinal sectional view taken through a prior art microphone assembly mounted to a bezel of a personal computer.
Figure 8:
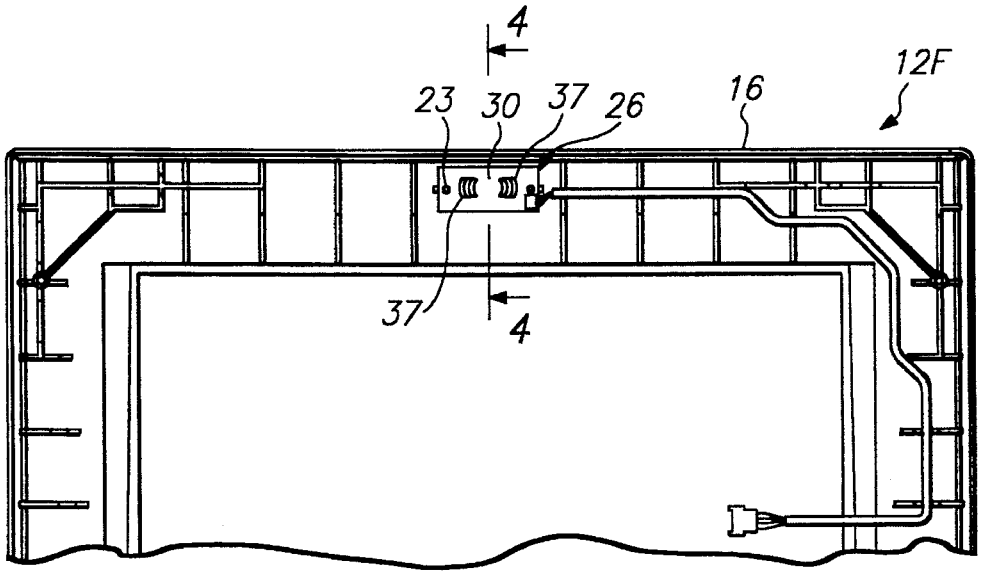
FIG. 8 is a rear elevational view of an upper portion of the bezel, with the microphone assembly attached thereto.
Figure 9:
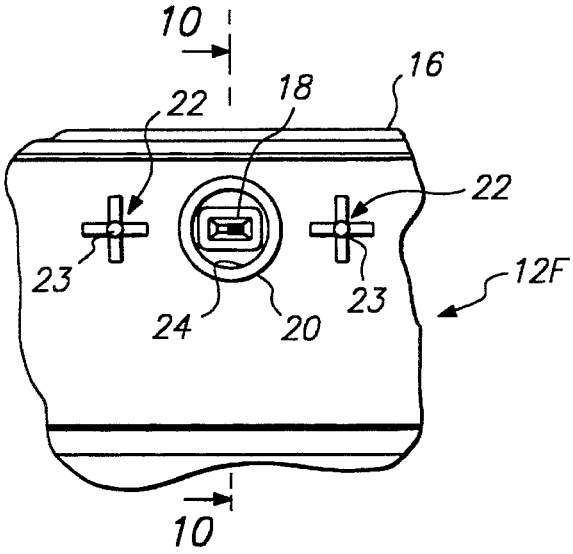
FIG. 9 is a fragmentary side elevational view of a rear surface of the portion of the bezel depicted in FIG. 7.
Figure 10:
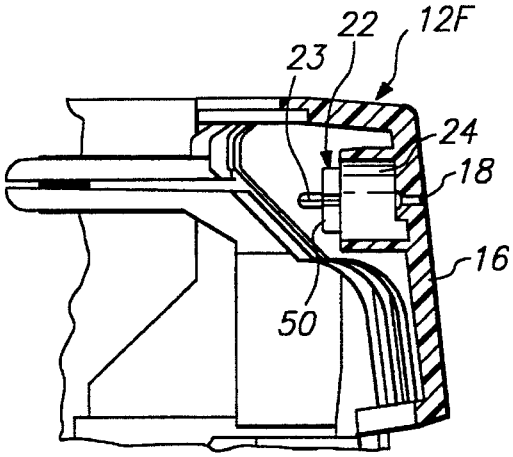
FIG. 10 is a sectional view taken along line 10—10 in FIG. 9.

The horizontal upper portion 16 includes a through-hole 18 extending from its inner surface to its outer surface. The inner surface includes a rearwardly extending cylindrical projection 20 forming a socket 24 arranged coaxially with the through-hole 18, and a pair of rearwardly projecting mounting posts 22 disposed on opposite sides of the projection 20 (see FIG. 7). Each post 22 is X-shaped in cross section and includes a cylindrical tip 23 at its outer end. A microphone assembly 26, depicted in FIGS. 3–6, includes a circuit board 30 having a pair of apertures 32 extending therethrough (see FIG. 4). Mounted to the apertures 32 is a body 36 in the form of a boot formed of a resilient material such as rubber (see also FIGS. 5 and 6). The body 36 includes rearwardly projecting spring fingers 37 arranged to snap into respective ones of the apertures 32 formed in the circuit board to form an interference fit with the circuit board. The end of each finger is in the form of an enlarged arc-shaped head, as shown in FIG. 8, and the apertures 32 are correspondingly arc-shaped. The body 36 also includes a forwardly opening annular groove 38 adapted to receive, with friction-fit, the cylindrical projection 20 of the bezel 12F. The body forms a cylindrical internal chamber 40 in which is mounted a microphone element 42 having rearwardly projecting electrodes 44 that are connectible to the circuit board 30. Extending forwardly through the body 36 from the chamber 40 is a rectangular through-hole 46.

The circuit board 30 includes a pair of holes 48 sized for loosely receiving the tips 23 of the mounting posts 22 of the bezel at the same time that the body 36 is pushed onto the socket 24, 20, in order to frictionally hold the microphone assembly in place. The posts 22 form shoulders 50 against which the circuit board abuts.

Once the microphone assembly has been installed, the sides of the groove 38 will frictionally grip therebetween the projection 20, and the circuit board 30 will be aligned by the posts 22.

It will be appreciated that the body 36 can be easily mounted to the circuit board by simply pushing the snap fingers 37 through the apertures 32 in the circuit board, thereby eliminating the need for applying an adhesive.

The circuit board need not be mounted with snaps, but rather is provided with holes to align with the posts in order to augment the frictional retention established by the engagement between the groove 38 and the projection 20 of the body 36.

It will be appreciated that the present invention is not limited to use in personal computers, but has utility in various types of appliances employing a microphone.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A microphone assembly for connection to a housing, comprising:

a circuit board having an aperture extending therethrough;

a body formed of resilient material, said body including:

a rearwardly projecting spring finger received in said aperture and forming an interference fit therewith for mounting said body to said circuit board, an interior chamber, a through-hole extending forwardly from said chamber and through said body, and a forwardly open groove encompassing said chamber and adapted to receive a wall of a socket to which the microphone assembly is mounted; and a microphone element mounted in said chamber and electrically connected to said circuit board.

2. The microphone assembly according to claim 1 wherein said groove is annular.

3. The microphone assembly according to claim 1 wherein said circuit board includes through-holes for receiving mounting posts on a structure to which the microphone assembly is to be connected.

4. The microphone assembly according to claim 1 wherein said body includes a plurality of said spring fingers.

5. In combination, an appliance having a housing, and a microphone assembly attached to said housing;

said housing including:

a wall having a sound-admitting through-hole therein, and a cylindrical projection extending from a surface of said wall to form a socket communicating with said through-hole;

said microphone assembly comprising:

a circuit board having an aperture formed therethrough, and a body mounted on said circuit board, said body comprising a rearwardly extending spring finger extending through said aperture to form an interference fit with said circuit board, an interior chamber, a forwardly open groove encompassing said chamber and receiving said projection with a friction-fit, and a hole communicating said chamber with said through-hole formed in said wall, and a microphone element mounted in said interior chamber and electrically connected to said circuit board.

6. The combination according to claim 5 wherein said body includes a plurality of said spring fingers.

7. The combination according to claim 5 wherein said wall of said housing includes a plurality of posts extending from said surface adjacent opposite sides of said projection, said circuit board including through-holes receiving respective ones of said posts.

8. The combination according to claim 5 wherein said groove is annular.

9. The combination according to claim 5 wherein said appliance is a personal computer, and said housing includes a front bezel on which said projection is formed.

* * * * *